US007359661B2

(12) United States Patent
Aoki et al.

(10) Patent No.: US 7,359,661 B2
(45) Date of Patent: Apr. 15, 2008

(54) DEVELOPING METHOD, DEVELOPING DEVICE, AND IMAGE FORMING APPARATUS INCLUDING THE DEVELOPING DEVICE THAT MINIMIZES DETERIORATION OF DEVELOPER

(75) Inventors: Katsuhiro Aoki, Yokohama (JP); Hajime Oyama, Ichikawa (JP); Hiromitsu Takagaki, Yokohama (JP); Hiroshi Ikeguchi, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 191 days.

(21) Appl. No.: 11/049,885

(22) Filed: Feb. 4, 2005

(65) Prior Publication Data

US 2005/0191095 A1 Sep. 1, 2005

(30) Foreign Application Priority Data

Feb. 4, 2004 (JP) ..... 2004-028058

(51) Int. Cl.
*G03G 15/08* (2006.01)

(52) U.S. Cl. ..... 399/281

(58) Field of Classification Search ..... 399/281, 399/282–295

See application file for complete search history.

(56) References Cited

U.S. PATENT DOCUMENTS

| | | | |
|---|---|---|---|
| 6,463,244 | B2 | 10/2002 | Aoki et al. |
| 6,505,014 | B2 | 1/2003 | Aoki et al. |
| 6,526,248 | B1 | 2/2003 | Aoki et al. |
| 6,608,984 | B1 | 8/2003 | Matsumoto et al. |
| 6,658,227 | B2 | 12/2003 | Oyama et al. |
| 6,721,516 | B2 | 4/2004 | Aoki et al. |
| 2004/0120733 | A1 | 6/2004 | Aoki et al. |
| 2004/0165913 | A1* | 8/2004 | Hattori ..... 399/258 |

FOREIGN PATENT DOCUMENTS

| | | |
|---|---|---|
| JP | 07-219329 | 8/1995 |
| JP | 08-106208 | 4/1996 |
| JP | 10/153181 | 6/1998 |
| JP | 2001-294323 | 10/2001 |
| JP | 2002-072650 | 3/2002 |
| JP | 2002-148937 | 5/2002 |
| JP | 2002205816 A * | 7/2002 |
| JP | 2002-226041 | 8/2002 |
| JP | 2003-005426 | 1/2003 |

(Continued)

*Primary Examiner*—David M. Gray
*Assistant Examiner*—Ryan Gleitz
(74) *Attorney, Agent, or Firm*—Oblon, Spivak, McClelland, Maier & Neustadt, P.C.

(57) ABSTRACT

A developing device includes a carrying roller to carry a developer, a storing section to store the developer, a supplying roller to supply the developer to the carrying roller by contacting the developer to the carrying roller, the supplying roller extending substantially parallel to the carrying roller. A conveying unit is configured to convey the developer stored in the storing section to the supplying roller. The conveying unit includes a pump with a stator having a through-hole, and a rotor disposed in the through-hole of the stator and spirally extended such that a cavity to convey the developer is formed. The rotor conveys the developer in the cavity in an axial direction of the rotor. Air is supplied to the developer, conveyed by the pump to scatter and fluidize the developer.

18 Claims, 7 Drawing Sheets

FOREIGN PATENT DOCUMENTS

| | | | | |
|---|---|---|---|---|
| JP | 2003-005433 | | | 1/2003 |
| JP | 2003-015346 | | | 1/2003 |
| JP | 2003-015347 | | | 1/2003 |
| JP | 2003-149911 | | | 5/2003 |
| JP | 2003207943 | A | * | 7/2003 |
| JP | 2004-045713 | | | 2/2004 |

* cited by examiner

DEVELOPING METHOD, DEVELOPING DEVICE, AND IMAGE FORMING APPARATUS INCLUDING THE DEVELOPING DEVICE THAT MINIMIZES DETERIORATION OF DEVELOPER

BACKGROUND OF THE INVENTION

1. Field of the Invention

The present invention relates to a developing device and a developing method for use in an electrophotographic image forming apparatus such as a copying machine, a printer, a facsimile machine, or other similar image forming apparatus.

2. Discussion of the Background

In a developing device that uses a one or two-component developer or toner, the developer accommodated in a developer hopper is supplied to a developing roller by agitating and conveying the developer by agitating members. The developer on the developing roller is charged by friction, and a uniform thin layer of the developer is formed on the developing roller by bringing a regulating member into contact with the developer on the developing roller. While rotating the developing roller, which is adjacent to or in contact with an image carrier (i.e., a photoreceptor), the developer adheres to a latent image formed on the image carrier. By this arrangement a toner image is formed on the image carrier. In this developing device, the developer is subjected to a significant mechanical stress both when a thin developer layer is formed on the developing roller by the regulating member and also when the developer is agitated and conveyed by the agitating member.

Generally, a toner is made from a binder resin into which a charge controlling agent (CCA) or a charge controlling resin (CCR) is mixed, and is charged by friction between the toner and a member. To obtain fluidity, inorganic external additives are attached on the periphery of the binder resin. By the attachment of the inorganic external additives, a non-electrostatic adhering force of the toner relative to other toner and members is decreased. The external additives themselves may be charged, thereby contributing to the charge of toner. However, because the hardness of the binder resin is significantly lower than that of metal, the external additives typically become embedded in the binder resin during a period when a developing process is repeated. This phenomenon occurs because the external additives become embedded in the softened binder resin due to the above-described mechanical stress. In this condition, although toner is sufficiently charged, the fluidity of toner decreases due to the embedded external additives, so that toner particles tend to adhere to each other and agglutinate. As a result, the non-electrostatic adhering force of the agglutinated toner relative to a developing roller increases, and the adhering force of toner on the developing roller increases. Further, a charging amount of toner decreases due to the decrease of the covering area of the external additives relative to the binder resin of toner. Consequently, developing performance of toner is decreased, and undesired results such as background fouling, and the decrease of image density, increasingly occur with time. Accordingly, toner easily adheres to members of the developing device, until the members and a developing unit of the developing device are replaced. Generally, the members and the developing unit are disposed of, which negatively impacts the environment.

Further, if the adhering force between toner particles increases due to embedded external additives when a lubricant such as powder of zinc stearate, and polytetrafluoroethylene (PTFE), to be applied to a photoreceptor adheres to the developing roller, an amount of toner adhering to the developing roller significantly decreases when forming a thin developer layer on the developing roller.

In the above-described developing device that supplies developer (toner) to the developing roller from the developer hopper acting as a developer storing section by using agitating and conveying members, the developer hopper or a developer replenishing tank is disposed in the vicinity of the developing roller. This causes the developing device to be designed to reside in a limited volume, and increases the size of a developing unit. Further, operability is degraded at the time of maintenance of members and units of the developing device.

Therefore, it is desirable to provide a developing device, and an image forming apparatus including the developing device that can form a high quality image for a long period of time by minimizing a mechanical deterioration of developer. Further, it is desirable to provide a developing method that can form a high quality image for a long period of time by minimizing a mechanical deterioration of developer.

SUMMARY OF THE INVENTION

The present invention can provide a developing device includes a carrying roller configured to carry a developer. A storing section is configured to store the developer. A supplying roller is configured to supply the developer to the carrying roller by contacting the developer to the carrying roller, the supplying roller extending substantially parallel to the carrying roller. A conveying unit is configured to convey the developer stored in the storing section to the supplying roller. The conveying unit includes a pump with a stator having a through-hole, and a rotor disposed in the through-hole of the stator and spirally extended such that a cavity to convey the developer is formed between an outer peripheral surface of the rotor and an inner peripheral surface of the through-hole of the stator, the rotor being configured to convey the developer in the cavity in an axial direction of the rotor by eccentrically rotating. An air supplying unit is configured to supply air to the developer conveyed by the pump to scatter and fluidize the developer.

The present invention can further provide an image forming apparatus including a latent image carrier configured to carry an electrostatic latent image, and the developing device configured to develop the electrostatic latent image with a developer.

The present invention can further provide a developing device including means for carrying a developer, means for storing the developer, means for supplying the developer to the means for carrying, the means for supplying extending substantially parallel to the means for carrying, and means for conveying the developer stored in the means for storing to the means for supplying, and means for supplying air to the developer conveyed by the pump to scatter and fluidize the developer.

The present invention can further provide a method of developing an electrostatic latent image on a latent image carrier with a developer, including conveying the developer from a storing section into a cavity formed between a rotor and a stator in a pump by pumping action of the pump, conveying the developer from the cavity to a supplying roller while scattering the developer by the pumping action, supplying the developer from the supplying roller to a carrying roller by contacting the developer to the carrying roller, and transferring the developer from the carrying roller to the electrostatic latent image on the latent image carrier.

The present invention can further provide a method of developing an electrostatic latent image on a latent image carrier with a developer, comprising conveying a developer from a storing section to a supplying roller, supplying the developer from the supplying roller to a carrying roller by contacting the developer to the carrying roller, transferring the developer from the carrying roller to the electrostatic latent image on the latent image carrier, collecting a residual developer remaining on the carrying roller, conveying the collected residual developer into a cavity formed between a rotor and a stator in a pump by pumping action of the pump, and returning the collected residual developer to one of the storing section and the supplying roller while scattering the developer by the pumping action.

The present invention can still further provide a process cartridge including the developing device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
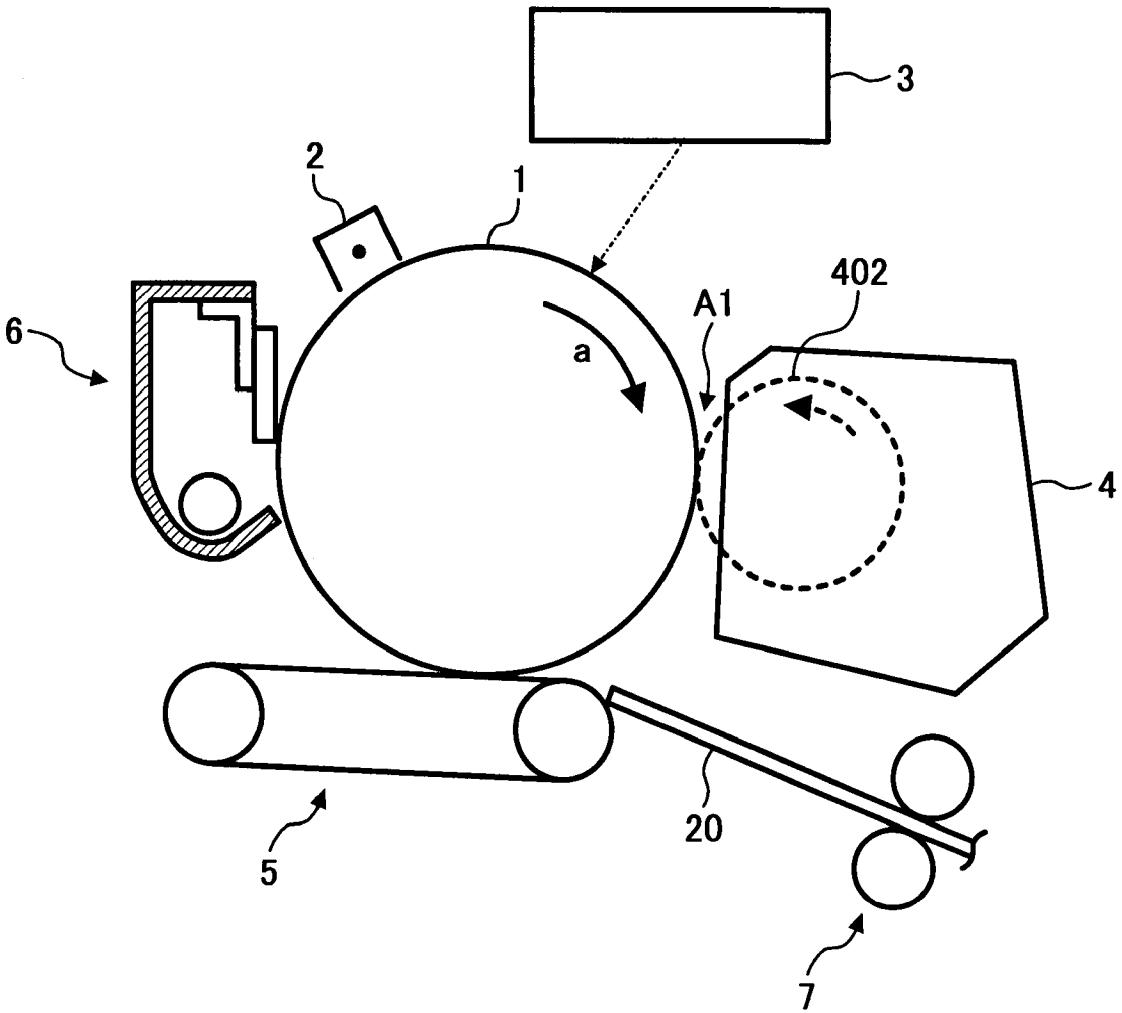
FIG. 1 is a side view of a portion of a printer according to an embodiment of the present invention.

Preferred embodiments of the present invention are described with reference to the drawings, wherein like reference numerals designate identical or corresponding parts throughout the views. In the preferred embodiment, the present invention is applied to an electrophotographic printer as an image forming apparatus. It is to be understood, however, that aspects of the present invention can be applied to any type of image forming apparatus, such as, a copying machine, printer, facsimile machine, etc. or a multi-functional image forming apparatus.

FIG. 1 is a side view of a portion of the printer according to an embodiment of the present invention. The printer includes a photoconductive drum 1 acting as a latent image carrier. A charging device 2, an exposing device 3, a developing device 4, a transfer device 5, and a cleaning device 6 are disposed around the drum 1. The charging device 2 uniformly charges the surface of the photoconductive drum 1. The exposing device 3 irradiates the surface of the photoconductive drum 1 with a laser light beam. The developing device 4 using a one-component developing method transfers charged toner from a developing roller 402 to an electrostatic latent image formed on the photoconductive drum 1, and forms a toner image on the photoconductive drum 1. In the one-component developing method, the developing device 4 uses a developer including one component, that is, a toner. The toner used in this embodiment can be a spherical toner having a high circularity. The weight average particle diameter of the toner is about 5.56 μm. However, the average particle diameter of the toner can be from about 3 μm to about 12 μm.

The transfer device 5 transfers the toner image formed on the photoconductive drum 1 onto a transfer sheet 20. The cleaning device 6 removes residual toner remaining on the photoconductive drum 1 after the transfer process. The printer can includes a sheet feeding/conveying device (not shown) that feeds and conveys the transfer sheet 20 from a sheet feeding tray (not shown), and/or a fixing device (not shown) that fixes the toner image transferred onto the transfer sheet 20 by the transfer device 5.

After the surface of the photoconductive drum 1, which is rotated in the direction indicated by arrow "a" in FIG. 1, is uniformly charged with a predetermined charging potential from about 300V to about 600V in an absolute value by the charging device 2, the exposing device 3 irradiates and scans the surface of the photoconductive drum 1 in its axial direction with a modulated laser light beam in accordance with image information. By this arrangement, an electrostatic latent image is formed on the photoconductive drum 1. The electrostatic latent image on the photoconductive drum 1 is formed into a toner image by adhering the toner charged in the developing device 4 onto the electrostatic latent image in a developing region A1.

The transfer sheet 20 is fed and conveyed from the sheet feeding/conveying device (not shown) to a pair of registration rollers 7. The registration rollers 7 feed out the transfer sheet 20 at an appropriate timing to a transfer region where the photoconductive drum 1 and the transfer device 5 face or oppose each other. The transfer device 5 transfers the toner image formed on the photoconductive drum 1 onto the transfer sheet 20 by applying an electric charge having an opposite polarity to that of the toner image on the photoconductive drum 1, to the transfer sheet 20. The transfer sheet 20 having the transferred toner image is separated from the photoconductive drum 1, and is conveyed to the fixing device (not shown) in which the toner image is fixed onto the transfer sheet 20. The transfer sheet 20 having the fixed toner image is output from the printer. The cleaning device 6 cleans the surface of the photoconductive drum 1 after the toner image is transferred from the photoconductive drum 1 onto the transfer sheet 20, and removes residual toner remaining on the photoconductive drum 1.

Features of the developing device 4 are described with reference to FIG. 2. The developing device 4 develops the electrostatic latent image formed on the photoconductive drum 1 with toner by forming a toner layer on the developing roller 402 acting as a developer carrying roller, and by conveying the toner layer to contact the photoconductive drum 1. The toner stored in a toner hopper 43 is conveyed and supplied to a toner supplying roller 412 acting as a developer supplying roller by a toner conveying unit 40 acting as a developer conveying unit. The toner supplying roller 412 extends parallel to the developing roller 402.

The toner supplying roller 412 can be flexible and can be formed from foamed polyurethane including cells each having a diameter of 50 μm to 500 μm. The toner supplying roller 412 is configured to easily hold toner. Further, because the toner supplying roller 412 has a relatively low hardness from about 10 degrees to about 30 degrees in JIS-A of Japanese Industrial Standards, the toner supplying roller 412 can evenly contact the developing roller 402. As illustrated in FIG. 2, the toner supplying roller 412 is driven to rotate in the same direction as the rotational direction of the developing roller 402. That is, the toner supplying roller 412 is driven to rotate such that the moving direction of the circumferential surface of the toner supplying roller 412 is opposite to the moving direction of the circumferential surface of the developing roller 402 at a nip part where the toner supplying roller 412 faces the developing roller 402. The linear velocity ratio between the toner supplying roller 412 and the developing roller 402 is preferably from about 0.5 to about 1.5. In the preferred embodiment, the linear velocity ratio between the toner supplying roller 412 and the developing roller 402 is 0.9. Alternatively, the toner supplying roller 412 may be driven to rotate in the opposite direction to the rotational direction of the developing roller 402. That is, the toner supplying roller 412 may be driven to rotate such that the moving direction of the circumferential surface of the toner supplying roller 412 is the same as the moving direction of the circumferential surface of the developing roller 402 at the nip part. It is set that the toner supplying roller 412 presses into the developing roller 402 by an interference amount from about 0.5 mm to about 1.5 mm. However, because the amount of interference depends on the charge and supply characteristics of toner, it is desirable to define an optimum condition of the interference amount in a broader range. Further, because the interference amount depends on the characteristics of a motor, gear head, and so forth included in a driveline used in the developing device 4, it is desirable to define an optimum condition of the intrusion amount taking components of the drive systems into consideration. In this embodiment, assuming that the effective width of the developing roller 402 is 240 mm (the effective width corresponds to the width of an A4 size sheet), a desired torque is from about 14.7 N·cm to about 24.5 N·cm (about 1.5 kgf·cm to about 2.5 kgf·cm).

The developing roller 402 is now described. When the photoconductive drum 1 is a rigid body including an aluminum substrate, the developing roller 402 is preferably formed from a rubber material having a hardness from about 10 degrees to about 70 degrees (JIS-A). Specific examples of rubber material include silicone rubber, butadiene rubber, nitrile-butadiene rubber (NBR), hydrin rubber, and EPDM. When a belt-shaped photoreceptor is used instead of the photoconductive drum 1, a metal roller having a relatively high hardness can be used as the developing roller 402 without disadvantage. Further, the diameter of the developing roller 402 is preferably from about 10 mm to about 30 mm. In this embodiment, the developing roller 402 has a diameter of 16 mm. The surface roughness of the developing roller 402 is from about 1 μm to about 4 μm in a ten point mean surface roughness (Rz) scale, in accordance with JIS. By this arrangement, the developing roller 402 can convey toner without burying or imbedding the toner in the surface of the developing roller 402.

It is preferable that the charging polarity of a coating material covering the surface of the developing roller 402 is opposite that of toner. Examples of the coating material include a resin material and a rubber material each containing silicone, acrylic, and polyurethane. To provide conductivity to the coating material of the developing roller 402, an adequate or predetermined amount of a conductive material, such as carbon black, may be contained in the coating material. Further, to uniformly coat the developing roller 402, another resin material may be mixed with the coating material. In this exemplary embodiment, two layers, i.e., a coat layer covering the surface of the developing roller 402, and a base layer superimposed on the coat layer, cover the developing roller 402. An electric resistance of each of the coat layer and the base layer is adjusted such that a volume resistivity of the two layers is from about $10^3$ ohm-cm to about $10^8$ ohm-cm. Although depending on the coating material, the developing roller 402 may be a single-layer developing roller in which a single layer covers the surface of the roller.

Generally, the surface of a developing roller is abraded over time, and substances including toner adhere to the abraded surface of the developing roller, resulting in a so-called toner filming typically occurring on the surface of the developing roller. The cause of the occurrence of toner filming is mainly an increase of adhering force between toner and the surface of the developing roller. In addition, the decrease of fluidity of toner due to the embedding of external additives into a toner particle may be another main cause of toner filming. Thus, developing performance can be stabilized by controlling the abrasion of a developing roller in a developing system and by providing a developing roller with a volume resistivity value that is maintained irrespective of the thickness of the developing roller. Examples of a material of a single layer covering a developing roller include a rubber material such as silicone rubber, butadiene rubber, nitrile-butadiene rubber (NBR), hydrin rubber, and EPDM, in which a conductive agent such as carbon black is dispersed. By forming the single layer with one or more of the above materials, the volume resistivity value of the developing roller does not change even when the surface of the developing roller is abraded.

The toner having a predetermined polarity (for example, negative polarity) on the toner supplying roller 412 or in a casing 401 of the developing device 4 obtains electric charge under a frictional charging effect produced by trapping the toner at the nip part between the toner supplying roller 412 and the developing roller 402 where the moving direction of the developing roller 402 and that of the toner supplying roller 412 are opposite to each other. Further, the toner is held on the developing roller 402 by electrostatic force and a conveyance effect obtained by the surface roughness of the developing roller 402. At this time, the layer of toner held on the developing roller 402 is not uniform, and an excessive amount of toner is adhered onto the developing roller 402 (for example, 1 to 3 mg/cm$^2$). For this reason, a thin and uniform toner layer is formed on the developing roller 402 by contacting a regulating blade 413 with the developing roller 402. In the illustrative embodiment, an edge of the regulating blade 413 is brought into contact with the surface of the developing roller 402. Alternatively, a predetermined width of the regulating blade 413 may contact the surface of the developing roller 402. The regulating blade 413 is formed from metal such as stainless steel (SUS304), and has a thickness from about 0.1 mm to about 0.15 mm. Alternatively, the regulating blade 413 may be formed from a rubber material such as polyurethane rubber having a thickness from about 1 mm to about 2 mm, or formed from a resin material such as silicone resin having a relatively high hardness. Other than metal, the regulating blade 413 may have low resistance by being formed from a material into which carbon black is mixed. Accordingly, an electric field can be formed between the developing roller 402 and the regulating blade 413 by connecting a bias power supply to the regulating blade 413. A thin toner layer also may be formed on the developing roller 402 by contacting a cylindrical regulating member with the surface of the developing roller 402.

The contact pressure of the regulating blade 413 is preferably from about 0.049 N/cm to about 2.45 N/cm (about 5 gf/cm to about 250 gf/cm). With regard to the influence of the contact pressure of the regulating blade 413 on a developing performance, if the contact pressure of the regulating blade 413 exceeds the upper limit, the amount of toner adhering onto the developing roller 402 decreases and the charging amount of toner excessively increases. As a result, an amount of toner of a developed image becomes low, and image density decreases. If the contact pressure of the regulating blade 413 falls below the lower limit, a thin toner layer may not be uniformly formed and agglomeration of toner typically passes through the contact part of the regulating blade 413 with the surface of the developing roller 402, so that image quality significantly degrades. In this embodiment, the hardness of the developing roller 402 is about 30 degrees (JIS-A), and the contact pressure of the regulating blade 413 relative to the developing roller 402 is about 60 gf/cm. The regulating blade 413 is formed from a SUS plate having a thickness of about 0.1 mm.

Excess toner is removed from the surface of the developing roller 402 by the regulating blade 413. Thereby, a thin toner layer having a uniform thickness from about 0.4 $mg/cm^2$ to about 0.8 $mg/cm^2$ can be formed on the developing roller 402. In this condition, the charge of toner is finally from about −10 μC/g to about −30 μC/g. The thin toner layer faces a latent image formed on the photoconductive drum 1, to develop the latent image with toner.

The toner conveying unit 40 disposed above the toner supplying roller 412 includes a uniaxial eccentric screw pump 41 including a stator 41*b* and a rotor 41*a*. The uniaxial eccentric screw pump 41 can be a so-called moineau pump. The stator 41*b* is formed from an elastic member such as rubber, and is formed into a shape of a female screw. The stator 41*b* includes a through-hole, and the inner peripheral surface of the through-hole of the stator 41*b* includes two spirally extended grooves. The rotor 41*a* is formed from materials such as metal and resin, and is formed into a shape of a male screw. The rotor 41*a* is disposed in the through hole of the stator 41*b* and spirally extended such that cavities 41*c* for conveying toner is formed between the outer peripheral surface of the rotor 41*a* and the inner peripheral surface of the through-hole of the stator 41*b*. The trailing edge of the rotor 41*a* is connected to a connecting rod connected to a drive shaft 45 of a drive device 46. The rotor 41*a* is eccentrically rotated in the through-hole of the stator 41*b* by rotating the drive shaft 45 of the drive device 46. By the pumping action of the stator 41*b* that moves and rotates in the through-hole of the stator 41*b*, toner is sucked into the cavity 41*c* from the toner hopper 43 through a toner conveying path 44. The rotor 41*a* conveys the sucked toner in the cavity 41*c* in its axial direction by eccentrically rotating, and discharges the sucked toner from the through-hole of the stator 41*b*.

The toner conveying unit 40 further includes an air supplying unit 47. The air supplying unit 47 includes an air pump 47*a*, an air supply tube 47*b*, and an air supply opening 47*c*. The air supply opening 47*c* communicates with the toner conveying path 44, and communicates with the air pump 47*a* through the air supply tube 47*b*. When the air pump 47*a* is actuated, compressed air is injected into the toner in the toner conveying path 44 through the air supply tube 47*b* and the air supply opening 47*c*. By supplying compressed air to the toner in the toner conveying path 44, the toner is scattered and fluidized. Thus, the toner conveyance performance of the toner conveying unit 40 can be enhanced. The air supplying unit 47 may be disposed at the downstream side of the screw pump 41 in the toner conveying direction, instead of the upstream side. Alternatively, the two air supplying units 47 may be disposed at the upstream and downstream sides of the screw pump 41 in the toner conveying direction, respectively. The toner stored in the toner hopper 43 is conveyed and supplied by the toner conveying unit 40 to a position between the toner supplying roller 412 and the developing roller 402.

In the screw pump 41 of the toner conveying unit 40, the inner peripheral surface of the stator 41*b* or the outer peripheral surface of the rotor 41*a* is coated with a material having low surface energy relative to the toner, that is, a material which tends to be charged with a polarity opposite to that of toner, such as a resin material, such that the thickness of the coating resin material is from about 1 μm to about 10 μm. Examples of the resin material include silicone resin and urethane resin. Alternatively, the screw pump 41 may have a three dimensional fabric construction, and the three dimensional fabric construction may be coated with the above-described material which tends to be charged with a polarity opposite to that of toner. By such coating, mechanical stress, which is applied to the toner by the time the toner is conveyed to the toner supplying roller 412, can be significantly decreased. Specifically, as the surface energy of the inner peripheral surface of the stator 41*b* and the outer peripheral surface of the rotor 41*a* is decreased, the adhesion of toner to the stator 41*b* and the rotor 41*a* can be prevented. Further, toner is sufficiently charged by contact-frictional charging during conveyance of the toner in the cavities 48 by the rotor 41*a*. Therefore, the developing roller 402 can receive the toner sufficiently charged in the screw pump 41 and in the nip part between the toner supplying roller 412 and the developing roller 402.

Figure 3:
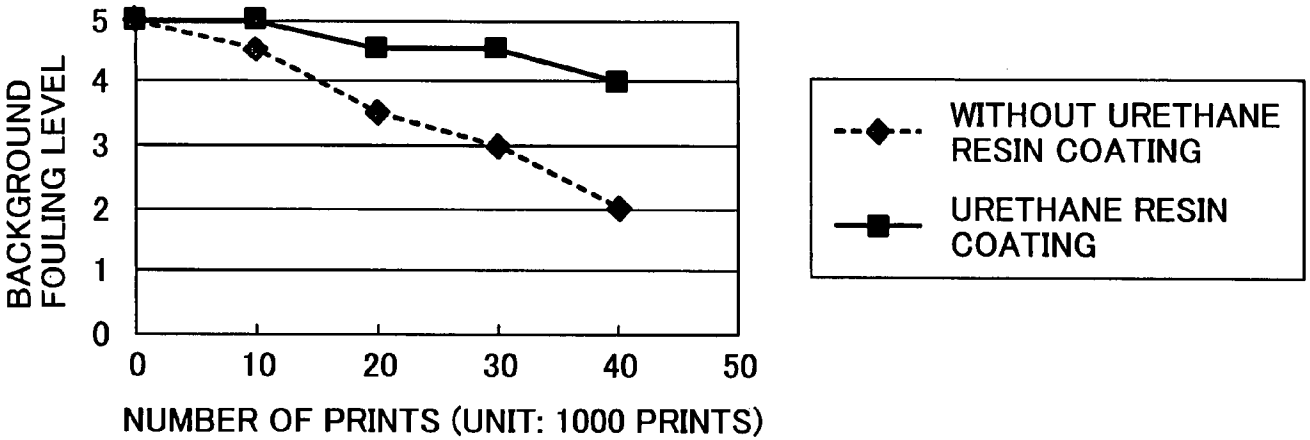
FIG. 3 is a graph showing a relationship between background fouling level and the number of prints, based on experimental results.

In a widely-used moineau pump, a stator is typically formed from chloroprene rubber, and when coating the inner peripheral surface of the stator with urethane resin, toner tends to be charged. FIG. 3 is a graph showing a relationship between background fouling level and the number of prints, based on experimental results. In experiments, toner was conveyed in a screw pump including a stator formed from chloroprene rubber without a urethane resin coating and in a screw pump including a stator whose inner peripheral surface was coated with urethane resin. The evaluation of background fouling occurred on a resultant image was made on a five-level basis. Level 5 indicates an optimal condition in which the printout sheet contains low density background fouling. Level 1 indicates an unacceptable condition in which the printout sheet contains high density background fouling. As seen from FIG. 3, the degree of background fouling can be prevented from becoming worse over time by using the stator whose inner peripheral surface is coated with urethane resin.

Figure 4:
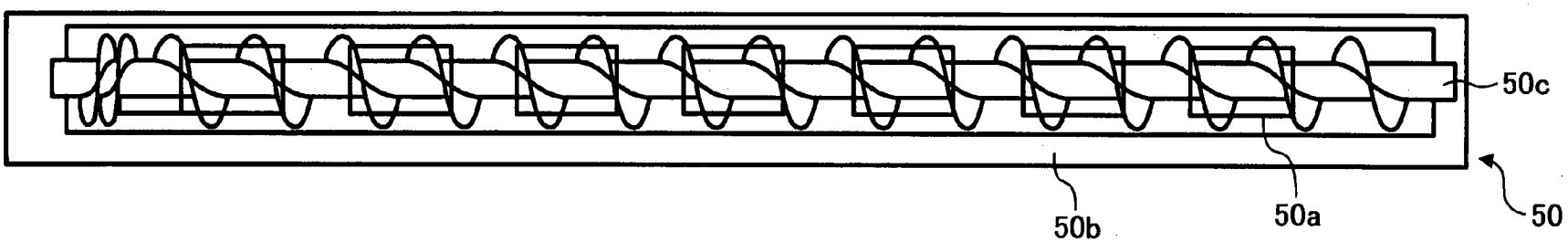
FIG. 4 is a top view of a toner distributing member according to the embodiment of the present invention.

For supplying toner from the toner supplying roller 412 to the developing roller 402, the toner conveyed from the toner conveying unit 40 to the toner supplying roller 412 should be distributed in the longitudinal direction of the toner supplying roller 412 on the toner supplying roller 412. Therefore, a toner distributing member 50 may be disposed between the toner conveying unit 40 and the toner supplying roller 412. As shown in FIG. 4, the toner distributing member 50 includes a cylindrical member 50*b* in which a plurality of upper and lower openings 50*a* are formed, and a screw 50*c* disposed in the cylindrical member 50*b*. The screw 50*c* extends parallel to the developing roller 402. The diameter of the cross section of the cylindrical member 50*b* is greater than the outer diameter of the screw 50*c* to minimize stress applied to the toner. The toner conveyed from the toner hopper 43 by the toner conveying unit 40 falls into the cylindrical member 50*b* through the upper openings 50*a* and is discharged from the cylindrical member 50*b* through the lower openings 50*a* toward the toner supplying roller 412. With the toner distributing member 50, the toner conveyed by the toner conveying unit 40 can be evenly transferred onto the toner supplying roller 412 in its longitudinal direction.

The toner distributed in the longitudinal direction of the toner supplying roller 412 is supplied to the developing roller 402 at the nip part between the toner supplying roller 412 and the developing roller 402 where the toner is spread against the surface of the developing roller 402, and is conveyed to the contact part of the regulating blade 413 with the surface of the developing roller 402. The toner is sandwiched between the regulating blade 413 and the developing roller 402 at the contact part, and is charged by friction between the toner and the surface of the developing roller 402 and by friction between the toner and the surface of the regulating blade 413. Subsequently, the toner is conveyed to the developing region A1 between the developing roller 402 and the photoconductive drum 1, and faces a latent image formed on the photoconductive drum 1. The latent image is developed with toner.

In the above-described developing device 4, influence caused by toner was examined. A representative generally used toner (background toner) and a preferable toner (new toner) for use in the present invention were prepared as follows.

Preparation of Background Toner

After sufficiently stirring and mixing the following components in a HENSHELL mixer, the mixture was heated and melted at 150° C. for two hours by small size two roll mills.

| | |
|---|---|
| Binder resin (styrene-methyl acrylate copolymer) | 100 parts |
| Coloring agent (carbon black #44 manufactured by Mitsubishi Carbon, Co.) | 10 parts |
| Charge controlling agent (Zinc di-t-butyl salicylate) (BONTRON E-84 manufactured by Orient Chemical Industries Co., Ltd.) | 2 parts |
| Carnauba wax | 5 parts |

After the mixture was coarsely pulverizing using a pulverizer with a 2 mm screen, the mixture was pulverized using a supersonic jet pulverizer LABO JET manufactured by Nippon Pneumatic Mfg. Co., Ltd., and followed by classification with a zigzag classifier 100MZR manufactured by ALPINE Corp. As a result, colored particles each having a diameter of 4 μm to 10 μm were obtained. In order to improve fluidity, developing performance, transfer performance, cleaning performance, and charging performance of toner, additives, i.e., 3 parts of silica, and 2 parts of titanium oxide particles (each additive has an average particle diameter of 20 nm) were added to 95 parts of the obtained colored particles. Then, the mixture was mixed with a HENSHELL mixer for two minutes, followed by filtering. By this process, the background toner was prepared. The circularity of the background toner, which was measured by a flow-type particle image analyzer FPIA-2000 manufactured by Sysmex Corporation, was 0.93, and the weight average particle diameter of the background toner was 5.73 μm.

Preparation of New Toner

The colored particles obtained in the preparation process of the background toner were subjected to a heat treatment twice using a SURFUSION SYSTEM manufactured by Nippon Pneumatic Mfg. Co., Ltd., to obtain new colored particles each having a diameter of 4 μm to 10 μm. The conditions of the treatments were as follows:

Heat treatment temperature: 250° C.

Hot airflow: 1000 liter per minute

Supplied airflow: 100 liter per minute

Figure 10:
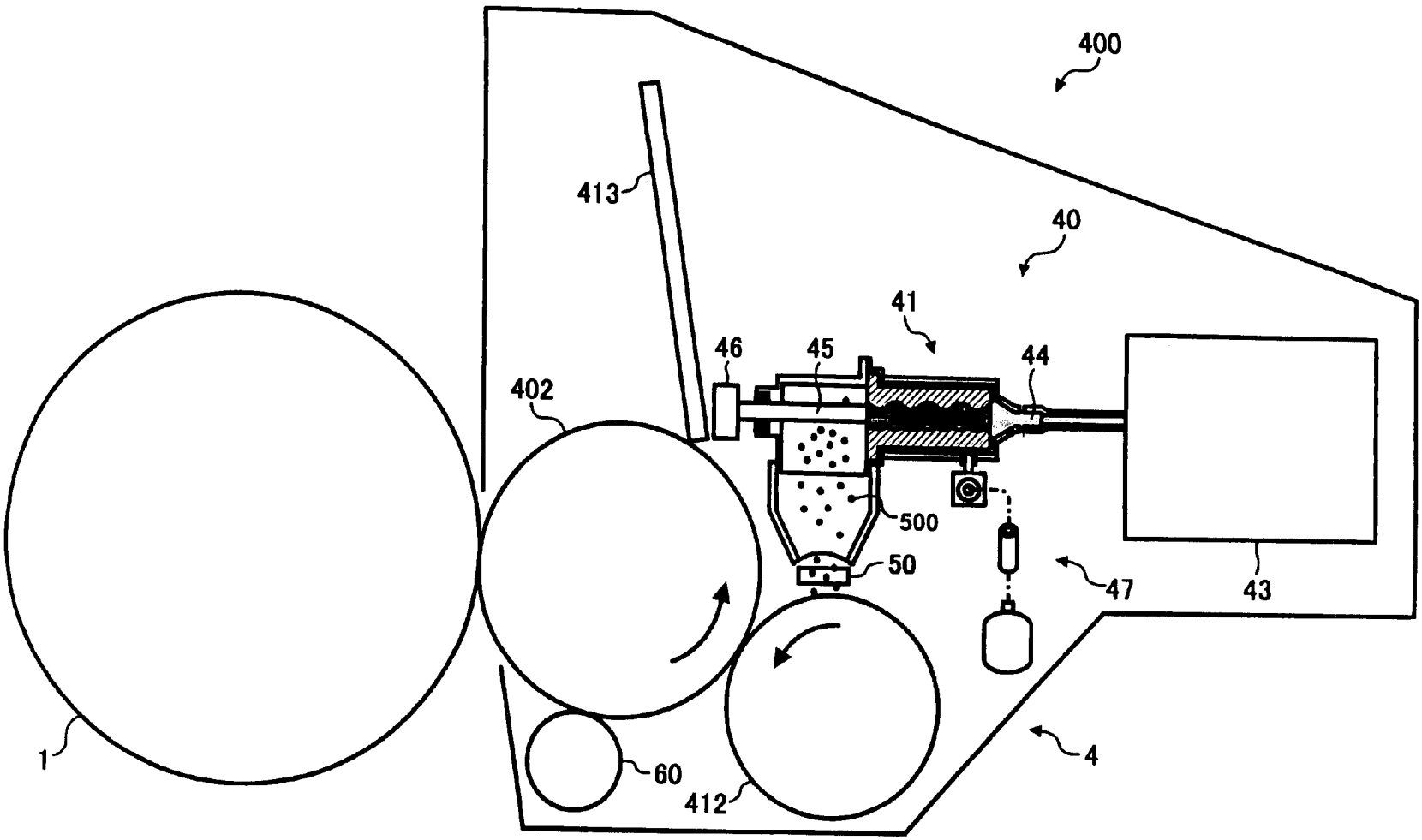
FIG. 10 is a side view of a process cartridge including the developing device of FIG. 2.

In order to improve fluidity, developing performance, transfer performance, cleaning performance, and charging performance of toner, additives such as 3 parts of silica, and 2 parts of titanium oxide particles (each additive has an average particle diameter of 60 nm) were added to 95 parts of the obtained colored particles. Then, the mixture was mixed with a HENSHELL mixer for two minutes, followed by filtering. By this process, the new toner for use in the present invention was prepared. The circularity of the new toner was 0.96, and the weight average particle diameter of the new toner was 5.56 μm. FIG. 2 and FIG. 10 show the new toner as having an inorganic fine particle 500 attached to the toner.

In this embodiment, the circularity of a toner was increased by subjecting the pulverized toner to the heat treatment. Instead of the heat treatment, the circularity of a toner may be increased by performing a mechanical treatment, such as a treatment using a turbo mill manufactured by Turbo Kogyo co., Ltd., which is described in Japanese Laid-Open Patent Application No. 9-85741, a treatment using a KRYPTRON SYSTEM manufactured by Kawasaki Heavy Industries, Ltd., and a treatment using a Q-form mixer manufactured by Mitsui Mining Co., Ltd. Alternatively, a toner having a high circularity may be prepared by a wet granulation method such as a suspension polymerization method, a dispersion polymerization method, and a dissolution suspension method. These wet granulation methods are superior in energy efficiency.

Figure 5:
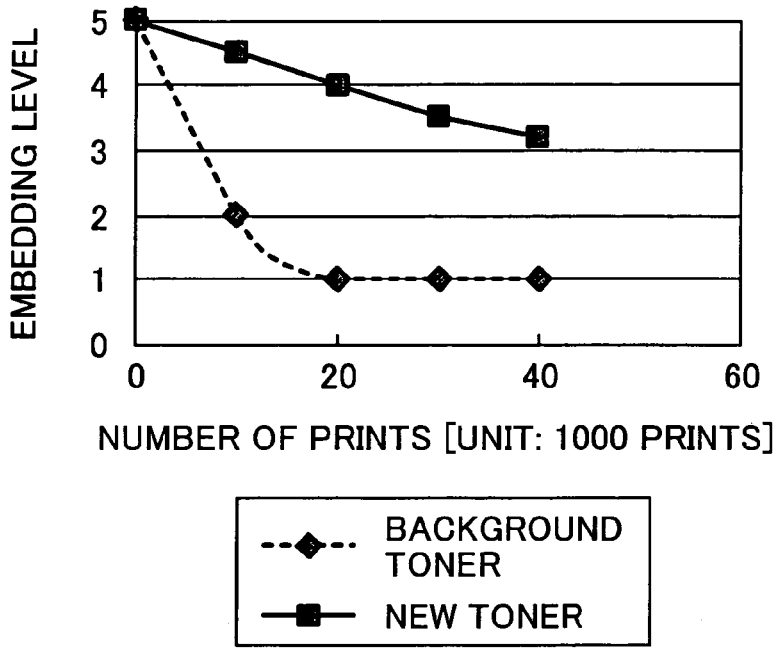
FIG. 5 is a graph showing a relationship between a level of embedding of external additives into toner particles and the number of prints, based on experimental results.

Experiments were conducted to examine the change of degree of embedding of external additives into toner particles with time by using the background toner and the new toner. FIG. 5 is a graph showing a relationship between the level of embedding of external additives into toner particles and the number of prints, based on experimental results. The evaluation of the degree of embedding of external additives into toner particles was made on a five-level basis. Level 5 indicates an optimal condition in which the degree to which external additives are embedded in the toner particles is minimized and a covering area of the external additives relative to a binder resin of toner is large. Level 1 indicates an unacceptable condition in which many external additives are embedded in toner particles and a covering area of the external additives relative to a binder resin of toner is small. As described above, when external additives are embedded in toner particles, the fluidity of toner decreases due to the embedded external additives, so that toner particles tend to adhere to each other and agglutinate. As a result, the non-electrostatic adhering force of the agglutinated toner relative to a developing roller increases, and the adhering force of toner on a developing roller increases. Further, a charging amount of toner decreases due to the decrease of the covering area of the external additives relative to the binder resin of toner. Consequently, the developing performance of the toner becomes inferior, resulting in undesired background fouling, and the decrease of image density, typically occurring over time. As seen from FIG. 5, the degree to which the external additives are embedded in toner particles can be prevented from increasing over time by using the new toner. Accordingly, occurrence of the above-described negative results can be minimized by using the new toner.

Figure 6:
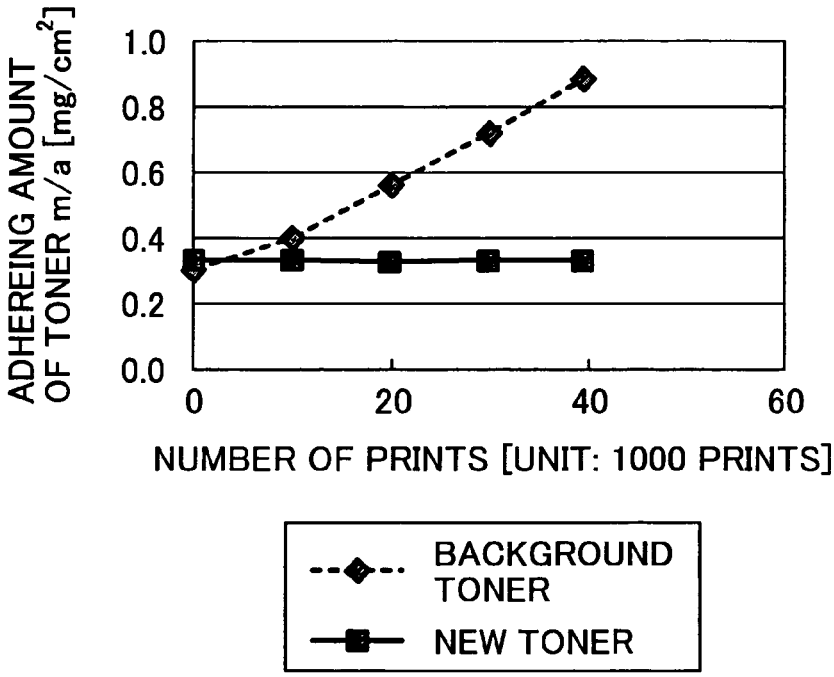
FIG. 6 is a graph showing a relationship between an amount of toner adhered onto a developing roller and the number of prints, based on experimental results.

Further, experiments were conducted to examine the change of an amount of toner adhered onto the developing roller 402 over time by using the background toner and the new toner. FIG. 6 is a graph showing a relationship between an amount of toner adhered onto the developing roller 402 and the number of prints, based on experimental results. As seen from FIG. 6, as compared to the background pulverized toner to which additives each having a small particle diameter (e.g., 20 nm) were added, an increase of the amount of toner adhered onto the developing roller 402 can be controlled by using the new spherical toner to which additives each having a large particle diameter (e.g., 60 nm) were added. Thus, image quality can be maintained by using the new toner.

Figure 7:
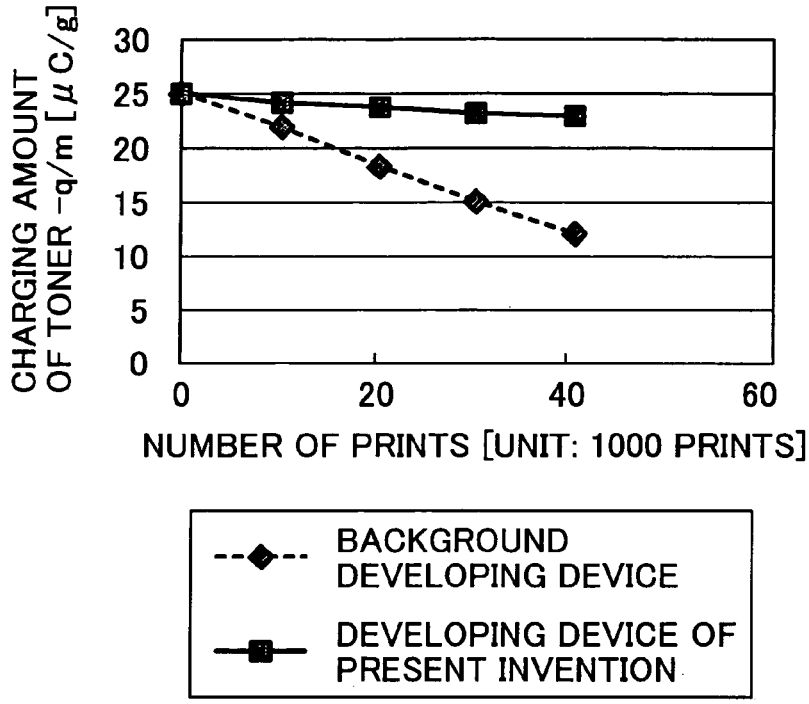
FIG. 7 is a graph showing a relationship between a charging amount of toner on a developing roller and the number of prints, based on experimental results.

Moreover, experiments were conducted to examine stress applied to the toner in a background developing device in which toner is supplied to a developing roller by agitating and conveying the toner by agitating members and in the developing device 4 in which toner is supplied to the developing roller 402 by conveying the toner using the toner conveying unit 40 and the toner supplying roller 412. In the experiments, the change of a charging amount of toner on a developing roller was checked to examine stress applied to the toner. FIG. 7 is a graph showing a relationship between a charging amount of toner on a developing roller and the number of prints, based on experimental results. As seen from FIG. 7, as compared to the background developing device, a decrease of a charging amount of toner on a developing roller can be controlled in the developing device 4 of the present invention. Because the application of mechanical stress to the toner can be minimized by conveying toner by the toner conveying unit 40, image quality can be maintained. The conditions of toner used in the experiments were as follows:

| | |
|---|---|
| Mother toner particle diameter: | 4 μm to 10 μm |
| Average particle diameter of a primary particle of an external additive: | 50 nm to 150 nm |

When the mother toner particle diameter is less than 4 μm, a surface area of a toner particle decreases, a contact area between toner particles adhering to each other decreases (due to a small curvature radius), and a distance between toner particles decreases under the influence of van der Waals force. In this condition, toner particles tend to agglutinate. In addition, toner particles adhere to a developing roller. As an amount of toner adhered onto the developing roller increases, toner filming and background fouling typically occur. When the mother toner particle diameter is greater than 10 μm, an uneven toner density becomes conspicuous, for example, at an edge portion of a developed latent image of 600 dpi, and image quality deteriorates.

When the average particle diameter of the primary particle of the external additive is less than 50 nm, the embedding of external additives into a binder resin of toner accelerates, and the toner tends to deteriorate. When the average particle diameter of the primary particle of the external additive is greater than 150 nm, toner tends to be caught in a contact part of a regulating blade with a surface of a developing roller. As a result, a uniform thin toner layer may not be formed on a developing roller, and a white streak image tends to occur.

Figure 8:
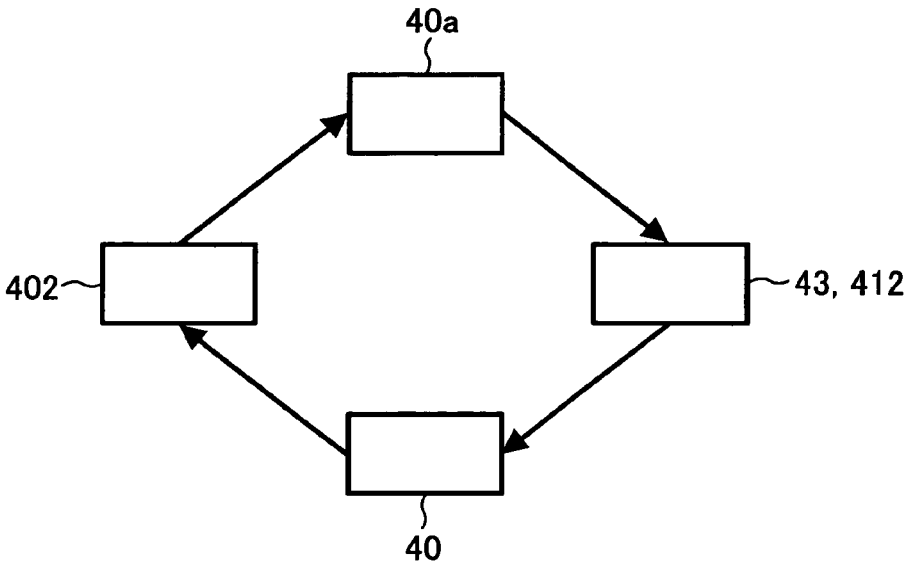
FIG. 8 is a diagram showing a toner conveying unit.

In the developing device 4 of the present embodiment, as shown in FIG. 8, a toner conveying unit 40*a* including components of the toner conveying unit 40 may be provided to suck toner remaining on the developing roller 402 after a developing process (i.e., after passing through the developing region A1 shown in FIG. 1 between the developing roller 402 and the photoconductive drum 1) and return the toner to the toner hopper 43. The toner returned to the toner hopper 43 is conveyed to the toner supplying roller 412 again by the toner conveying unit 40. Once the toner passes through the contact part of the regulating blade 413 with the surface of the developing roller 402 and is contained in a thin toner layer, mechanical stress is applied to the toner, and the embedding of external additives into a toner particle is accelerated. Therefore, toner remaining on the developing roller 402 after a developing process is removed therefrom before a succeeding developing process by the toner conveying unit 40*a*. As an alternative example, the toner removed from the developing roller 402 may be returned to the toner supplying roller 412 by the toner conveying unit 40*a*, instead of returning to the toner hopper 43.

Figure 2:
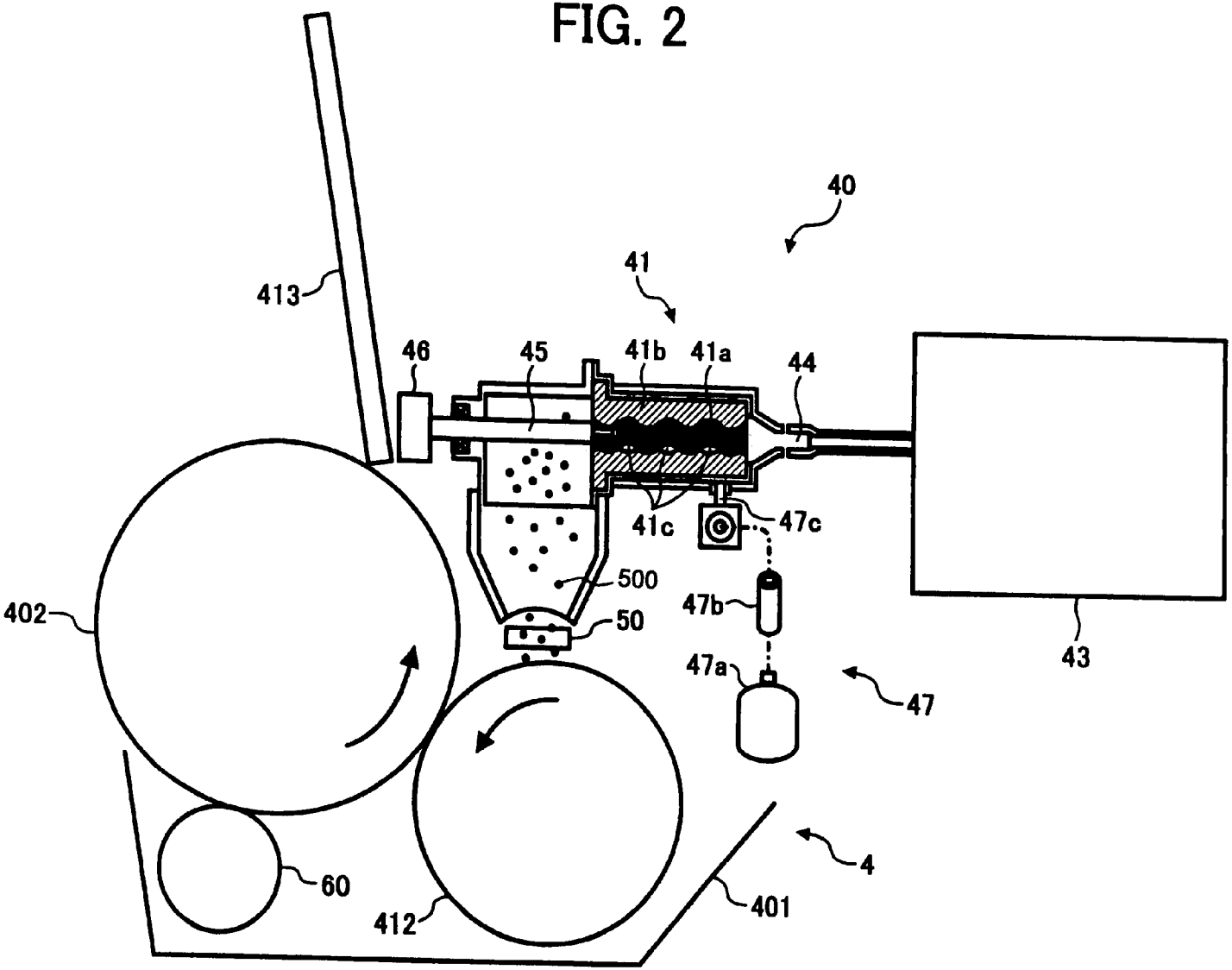
FIG. 2 is a partial cross sectional view of a developing device in the printer of FIG. 1.
Figure 9:
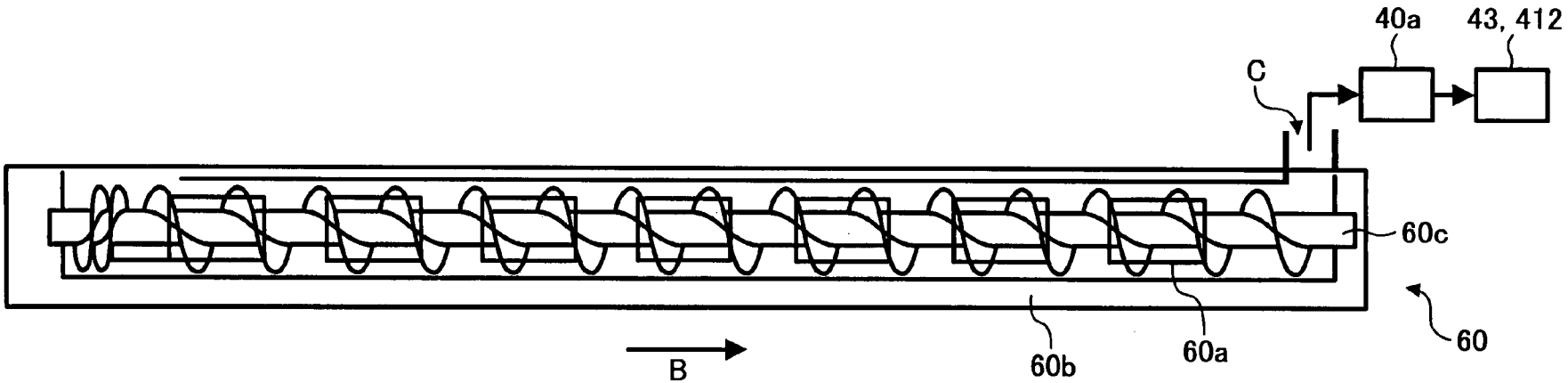
FIG. 9 is a top view of a toner collecting member according to the embodiment of the present invention.

As shown in FIG. 2, the developing device 4 further includes a residual toner collecting member 60 at the downstream side of the developing region A1 in the rotational direction of the developing roller 402. As shown in FIG. 9, the residual toner collecting member 60 includes a cylindrical member 60*b* in which a plurality of openings 60*a* are formed, and a screw 60*c* disposed in the cylindrical member 60*b*. The screw 60*c* extends parallel to the developing roller 402. The diameter of the cross section of the cylindrical member 60*b* is greater than the outer diameter of the screw 60*c* to minimize stress applied to the toner. The residual toner collecting member 60 collects residual toner remaining on the developing roller 402 after a developing process (i.e., after passing through the developing region A1). The residual toner collecting member 60 takes in the residual toner through the openings 60*a*, and conveys the toner in the direction indicated by arrow B in FIG. 9 toward a toner outlet C formed at one end side of the residual toner collecting member 60. The toner conveying unit 40*a* is connected to the toner outlet C of the residual toner collecting member 60 to suck the residual toner collected by the residual toner collecting member 60 thereinto. Subsequently, the toner conveying unit 40*a* returns the sucked residual toner to the toner hopper 43 or the toner supplying roller 412.

In the printer of the present embodiment, as shown in FIG. 10, the elements of the developing device 4 are integrally disposed in a process cartridge 400. The process cartridge 400 is detachably attachable to a main body of the printer. Therefore, maintenance of the apparatus and replacement of parts can be easily and efficiently performed. The construction of the process cartridge 44 is not limited to that shown in FIG. 10. In another embodiment, the process cartridge 400 may integrally accommodate at least the developing roller 402, the toner supplying roller 412, and the residual toner collecting member 60 of the developing device 4. In another embodiment, the process cartridge 400 may integrally accommodate the developing device 4 and the photosensitive drum 1 or may integrally accommodate the developing device 4, the photoconductive drum 1, the charging device 2, and the cleaning device 6.

In the above-described developing device 4 according to the embodiment of the present invention, a mechanical stress applied to the toner during a conveyance of toner to the developing roller 402 can be minimized, and charging performance of toner can be maintained by preventing an increase of adhesion force between toner particles. Thus, a high quality image can be formed over a long period of time by minimizing a deterioration of toner.

Further, in the developing device 4, because the toner hopper 43 as a toner storing section is disposed away from a drive section of the developing device 4, the toner stored in the toner hopper 43 can be prevented from being affected by heat produced in a developing section. Additionally, a mechanical stress applied to the toner during a conveyance of the toner to the developing roller 402 can be minimized by using the toner conveying unit 40. Thus, deterioration of the toner can be decreased, and adhesion of the toner to members of the developing device 4 and an occurrence of toner filming can be decreased. Consequently, the useful lifetime of the members and a developing unit of the developing device can be extended, so that the members and the developing unit of the developing device need not be replaced frequently. The environmental impact is decreased because disposal of the member and the developing unit is decreased.

Moreover, as compared to a developing device that supplies developer to a developing roller from a developer hopper by using agitating and conveying members, the developing device 4 according to the embodiment of the present invention need not provide agitating and conveying members in the casing 401 thereof. Therefore, the size of a developing unit in the casing 401 in which toner is supplied to the developing roller 402 can be decreased, and therefore the size of the printer can be decreased. Further, because a toner storing section (e.g., the toner hopper 43) can be disposed any location in the developing device 4 by use of the toner conveying unit 40, the layout of the printer is not restricted.

In the printer of the present embodiment, a toner image formed on the photoconductive drum 1 is directly transferred onto the transfer sheet 20 by the transfer device 5. Alternatively, a toner image formed on the photoconductive drum 1 may be primarily transferred onto an intermediate transfer element, and the toner image transferred onto the intermediate transfer element may be secondarily transferred onto a transfer sheet. For example, the present invention can be applied to a color image forming apparatus including color developing devices. In the color image forming apparatus, a toner image of each color is sequentially formed on a photoreceptor. The toner image of each color formed on the photoreceptor is sequentially transferred onto an intermediate transfer element while being superimposed on one another by a primary transfer device. Subsequently, a superimposed color image is transferred from the intermediate transfer element to a transfer sheet by a secondary transfer device.

Alternatively, the present invention can be applied to a tandem type color image forming apparatus including color developing devices. In the tandem type color image forming apparatus, a plurality of image forming units including respective photoreceptors are disposed in line along an extending part of an intermediate transfer element. Toner images of different colors, which have been formed on the respective photoreceptors, are transferred onto the intermediate transfer element while being superimposed on one another by respective primary transfer devices. Subsequently, a superimposed color image is transferred from the intermediate transfer element to a transfer sheet by a secondary transfer device.

Numerous additional modifications and variations of the present invention are possible in light of the above teachings. It is therefore to be understood that within the scope of the appended claims, the present invention may be practiced otherwise than as specifically described herein.

This application claims priority to Japanese application no. 2004-028058, filed on Feb. 4, 2004, the disclosure of which is incorporated by reference herein in its entirety.

What is claimed:

1. A developing device, comprising:

a carrying roller configured to carry a developer;

a storing section configured to store the developer;

a supplying roller configured to supply the developer to the carrying roller by contacting the developer to the carrying roller, the supplying roller extending substantially parallel to the carrying roller;

a first conveying unit configured to convey the developer stored in the storing section to the supplying roller, the first conveying unit comprising a pump including a stator having a through-hole, and a rotor disposed in the through-hole of the stator and spirally extended such that a cavity to convey the developer is formed between an outer peripheral surface of the rotor and an inner peripheral surface of the through-hole of the stator, the rotor being configured to convey the developer in the cavity in an axial direction of the rotor by eccentrically rotating;

a distributing member configured to distribute onto the supplying roller the developer conveyed by the first conveying unit so that the developer comes down freely from the distributing member under the influence of gravity onto the supplying roller; and an air supplying unit configured to supply air to the developer conveyed by the pump to scatter and fluidize the developer.

2. The developing device according to claim 1, wherein the distributing member is configured to distribute the developer conveyed by the first conveying unit in the longitudinal direction of the carrying roller.

3. The developing device according to claim 1, further comprising a second conveying unit configured to convey the developer from the carrying roller to one of the storing section and the supplying roller.

4. The developing device according to claim 1, further comprising a toner having a circularity of 0.96 or greater.

5. The developing device according to claim 4, wherein a particle diameter of the toner is from 4 μm to 10 μm, and a particle diameter of an inorganic fine particle attached to the toner is from 50 nm to 150 nm.

6. An image forming apparatus, comprising:

a latent image carrier configured to carry an electrostatic latent image; and a developing device configured to develop the electrostatic latent image with a developer, the developing device comprising a carrying roller configured to carry the developer;

a storing section configured to store the developer;

a supplying roller configured to supply the developer to the carrying roller by contacting the developer to the carrying roller, the supplying roller extending substantially parallel to the carrying roller;

a first conveying unit configured to convey the developer stored in the storing section to the supplying roller, the first conveying unit comprising a pump including a stator having a through-hole, and a rotor disposed in the through-hole of the stator and spirally extended such that a cavity to convey the developer is formed between an outer peripheral surface of the rotor and an inner peripheral surface of the through-hole of the stator, the rotor being configured to convey the developer in the cavity in an axial direction of the rotor by eccentrically rotating;

a distributing member configured to distribute onto the supplying roller the developer conveyed by the first conveying unit so that the developer comes down freely from the distributing member under the influence of gravity onto the supplying roller; and an air supplying unit configured to supply air to the developer conveyed by the pump to scatter and fluidize the developer.

7. The image forming apparatus according to claim 6, wherein the distributing member is configured to distribute the developer conveyed by the first conveying unit in the longitudinal direction of the carrying roller.

8. The image forming apparatus according to claim 6, further comprising a second conveying unit configured to convey the developer from the carrying roller to one of the storing section and the supplying roller.

9. The image forming apparatus according to claim 6, further comprising a toner having a circularity of 0.96 or greater.

10. The image forming apparatus according to claim 9, wherein a particle diameter of the toner is from 4 μm to 10 μm, and a particle diameter of an inorganic fine particle attached to the toner is from 50 nm to 150 nm.

11. A developing device, comprising:

means for carrying a developer;

means for storing the developer;

means for supplying the developer to the means for carrying by contacting the developer to the means for carrying, the means for supplying extending substantially parallel to the means for carrying;

first means for conveying the developer stored in the means for storing to the means for supplying, the first means for conveying comprising a pump including a stator having a through-hole, and a rotor disposed in the through-hole of the stator and spirally extended such that a cavity to convey the developer is formed between an outer peripheral surface of the rotor and an inner peripheral surface of the through-hole of the stator, the rotor being configured to convey the developer in the cavity in an axial direction of the rotor by eccentrically rotating;

means for distributing onto the means for supplying the developer conveyed by the first means for conveying so that the developer comes down freely from the means for distributing under the influence of gravity onto the means for supplying; and means for supplying air to the developer conveyed by the pump to scatter and fluidize the developer.

12. The developing device according to claim 11, wherein the means for distributing is configured to distribute the developer conveyed by the first means for conveying in the longitudinal direction of the means for carrying.

13. The developing device according to claim 11, further comprising second means for conveying the developer from the means for carrying to one of the means for storing and the means for supplying.

14. A process cartridge comprising:

a developing device comprising a carrying roller configured to carry a developer;

a storing section configured to store the developer;

a supplying roller configured to supply the developer to the carrying roller by contacting the developer to the carrying roller, the supplying roller extending substantially parallel to the carrying roller;

a first conveying unit configured to convey the developer stored in the storing section to the supplying roller, the first conveying unit comprising a pump including a stator having a through-hole, and a rotor disposed in the through-hole of the stator and spirally extended such that a cavity to convey the developer is formed between an outer peripheral surface of the rotor and an inner peripheral surface of the through-hole of the stator, the rotor being configured to convey the developer in the cavity in an axial direction of the rotor by eccentrically rotating;

a distributing member configured to distribute onto the supplying roller the developer conveyed by the first conveying unit so that the developer comes down freely from the distributing member under the influence of gravity onto the supplying roller; and an air supplying unit configured to supply air to the developer conveyed by the pump to scatter and fluidize the developer.

15. The process cartridge according to claim 14, wherein the distributing member is configured to distribute the developer conveyed by the first conveying unit in the longitudinal direction of the carrying roller.

16. The process cartridge according to claim 14, wherein the developing device comprises a second conveying unit configured to convey the developer from the carrying roller to one of the storing section and the supplying roller.

17. The process cartridge according to claim 14, further comprising a toner having a circularity of 0.96 or greater.

18. The process cartridge according to claim 17, wherein a particle diameter of the toner is from 4 μm to 10 μm, and a particle diameter of an inorganic fine particle attached to the toner is from 50 nm to 150 nm.

* * * * *